US010574373B2

(12) United States Patent
Dillon

(10) Patent No.: US 10,574,373 B2
(45) Date of Patent: Feb. 25, 2020

(54) ACR-BASED RADIO METADATA IN THE CLOUD

(71) Applicant: Ibiquity Digital Corporation, Columbia, MD (US)

(72) Inventor: Robert Michael Dillon, Mendham, NJ (US)

(73) Assignee: Ibiquity Digital Corporation, Columbia, MD (US)

( * ) Notice: Subject to any disclaimer, the term of this patent is extended or adjusted under 35 U.S.C. 154(b) by 160 days.

(21) Appl. No.: 15/671,768

(22) Filed: Aug. 8, 2017

(65) Prior Publication Data

US 2019/0052387 A1 Feb. 14, 2019

(51) Int. Cl.
*H04H 60/74* (2008.01)
*H04H 60/37* (2008.01)
(Continued)

(52) U.S. Cl.
CPC ..... *H04H 60/74* (2013.01); *H04H 60/372* (2013.01); *H04H 60/58* (2013.01);
(Continued)

(58) Field of Classification Search
CPC ..... G06F 16/68; G06F 16/683; G06F 16/686; G06F 16/687; H04H 20/28; H04H 20/30; H04H 20/31; H04H 20/33; H04H 20/34; H04H 20/72; H04H 60/35; H04H 60/37; H04H 60/372; H04H 60/58; H04H 60/61; H04H 60/64; H04H 60/65; H04H 60/68;
(Continued)

(56) References Cited

U.S. PATENT DOCUMENTS 6,628,928 B1 * 9/2003 Crosby ..... H04H 60/37 455/150.1
6,834,308 B1 * 12/2004 Ikezoye ..... G06F 16/7834 709/231
(Continued)

FOREIGN PATENT DOCUMENTS

WO WO-2015162294 A1 10/2015

OTHER PUBLICATIONS

"International Application Serial No. PCT/US2018/045374, International Search Report dated Oct. 18, 2018", 2 pgs.
(Continued)

*Primary Examiner* — Michael Won
*Assistant Examiner* — William C McBeth
(74) *Attorney, Agent, or Firm* — Schwegman Lundberg & Woessner, P.A.

(57) ABSTRACT

A system comprises a first server including a port, a memory, a processor operatively coupled to the port and memory, and a service application for execution by the processor. The service application is configured to: receive identification information related to an over-the-air radio broadcast via the port of the first server, wherein the identification information is transmitted to the first server using a radio broadcast receiver remote from the first server, communicate a request for automatic content recognition (ACR) of an Internet-based streaming version of the over-the-air radio broadcast; and receive metadata associated with the over-the-air radio broadcast in response to the request and initiate transmission of the metadata to the radio broadcast receiver.

20 Claims, 6 Drawing Sheets

(51) Int. Cl.

| | |
|---|---|
| ***H04H 60/58*** | (2008.01) |
| ***H04H 60/64*** | (2008.01) |
| ***H04H 60/82*** | (2008.01) |
| ***H04H 60/90*** | (2008.01) |
| *H04H 60/61* | (2008.01) |
| *H04H 60/73* | (2008.01) |
| *H04H 60/68* | (2008.01) |
| *H04H 20/31* | (2008.01) |
| *H04H 20/72* | (2008.01) |

(52) U.S. Cl.
CPC ..... *H04H 60/64* (2013.01); *H04H 60/82* (2013.01); *H04H 60/90* (2013.01); *H04H 20/31* (2013.01); *H04H 20/72* (2013.01); *H04H 60/37* (2013.01); *H04H 60/61* (2013.01); *H04H 60/68* (2013.01); *H04H 60/73* (2013.01); *H04H 2201/30* (2013.01); *H04H 2201/40* (2013.01)

(58) Field of Classification Search
CPC ..... H04H 60/73; H04H 60/74; H04H 60/82; H04H 60/90; H04H 2201/30; H04H 2201/40
See application file for complete search history.

(56) References Cited

U.S. PATENT DOCUMENTS

| | | | | |
|---|---|---|---|---|
| 7,471,677 | B2 | 12/2008 | Deshpande | |
| 7,523,312 | B2 | 4/2009 | Kalker et al. | |
| 7,881,657 | B2 | 2/2011 | Wang et al. | |
| 8,331,966 | B2 | 12/2012 | Anzures et al. | |
| 8,401,580 | B2 | 3/2013 | Anzures et al. | |
| 9,026,546 | B2 | 5/2015 | Emerson | |
| 9,049,496 | B2 | 6/2015 | Raesig | |
| 9,330,647 | B1 | 5/2016 | Bay et al. | |
| 9,418,669 | B2 | 8/2016 | Emerson | |
| 2002/0183059 | A1* | 12/2002 | Noreen | H04H 60/33 455/414.1 |
| 2004/0244042 | A1 | 12/2004 | Billmaier | |
| 2005/0176366 | A1* | 8/2005 | Levy | H04H 60/74 455/3.06 |
| 2006/0218613 | A1* | 9/2006 | Bushnell | H04H 60/74 725/109 |
| 2009/0205000 | A1* | 8/2009 | Christensen | H04H 60/37 725/61 |
| 2010/0057781 | A1* | 3/2010 | Stohr | H04H 60/37 707/E17.009 |
| 2010/0291861 | A1* | 11/2010 | Anzures | H04H 60/74 455/3.01 |
| 2011/0124283 | A1* | 5/2011 | DeLuca | H04H 60/74 455/3.06 |
| 2012/0047156 | A1* | 2/2012 | Jarvinen | H04H 60/37 707/758 |
| 2013/0071090 | A1* | 3/2013 | Berkowitz | H04N 21/6582 386/248 |
| 2013/0254793 | A1* | 9/2013 | Anniballi | H04H 60/64 725/18 |
| 2014/0089309 | A1* | 3/2014 | Ibasco | H04H 60/372 707/736 |
| 2014/0282657 | A1 | 9/2014 | Sinha et al. | |
| 2014/0335834 | A1 | 11/2014 | Emerson | |
| 2014/0336799 | A1 | 11/2014 | Emerson | |
| 2016/0352793 | A1 | 12/2016 | Lee et al. | |
| 2017/0013028 | A1 | 1/2017 | Yang et al. | |

OTHER PUBLICATIONS

"International Application Serial No. PCT/US2018/045374, Written Opinion dated Oct. 18, 2018", 8 pgs.

* cited by examiner

ACR-BASED RADIO METADATA IN THE CLOUD

TECHNICAL FIELD

The technology described in this patent document relates to systems and methods for providing supplemental data (e.g., metadata) that is associated with over-the-air radio broadcast signals.

BACKGROUND

Over-the-air radio broadcast signals are commonly used to deliver a variety of programming content (e.g., audio, etc.) to radio receiver systems. Such over-the-air radio broadcast signals can include conventional AM and FM analog broadcast signals, digital radio broadcast signals, or other broadcast signals. Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. It is desirable to provide supplemental data with an audio broadcast. This supplemental data can include a name, call sign and a logo of the radio station broadcasting the signal for display on a radio broadcast receiver to a user. It can be challenging to coordinate delivery of the supplemental data with the broadcast received at the user's location.

DESCRIPTION

Figure 1:
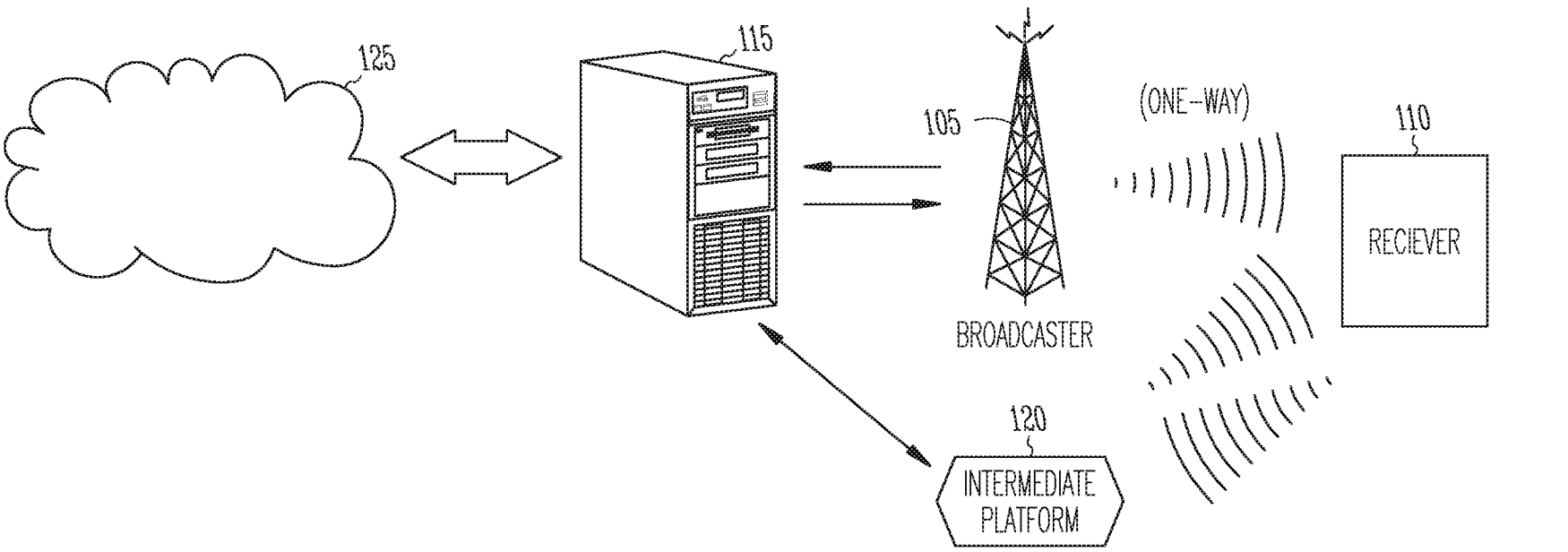
FIG. 1 is an illustration of portions of an example of a radio broadcast system for providing supplemental data to one or more radio broadcast receivers.

Over-the-air radio broadcast signals are commonly used to deliver a variety of programming content (e.g., audio, etc.) to radio receiver systems. Supplemental data (e.g., metadata) may be provided to radio broadcast receiver systems. The metadata is associated with the programming content delivered via the over-the-air radio broadcast signals. The metadata can be included in a sub-carrier data. In IBOC, the radio broadcast includes a streamed analog broadcast and may include a digital audio broadcast. Sub-carriers of the main channel broadcast can include digital information such as text or numeric information, and the metadata can be included in the digital information of the sub-carriers. Thus, an over-the-air radio broadcast can include an analog audio broadcast, a digital audio broadcast, and other text and numeric digital information such as metadata streamed with the over-the-air broadcast. The programming content may be broadcast according to the DAB standard, the digital radio mondiale (DRM) standard, radio data system (RDS) protocol, or the radio broadcast data system (RIDS) protocol.

A radio broadcast receiver system may receive both the primary programming content (e.g., audio, etc.) via over-the-air radio broadcast transmission, and the metadata related to the programming content. In some examples, the receiver may receive both the over-the-air radio broadcast and related information wirelessly from the Internet. Thus, two different communication platforms can be used to communicate metadata, with the different communication platforms enabling the radio receiver system to receive relevant metadata in concert with terrestrial radio broadcast signals. Such a system can be described as a "hybrid radio" system.

The metadata related to the programming content can include both "static" metadata and "dynamic" metadata. Static metadata changes infrequently or does not change. The static metadata may include the radio station's call sign, name, logo (e.g., higher or lower logo resolutions), slogan, station format, station genre, language, web page uniform resource locator (URL), URL for social media (e.g., Facebook, Twitter), phone number, SMS number, SMS short code, PI code, country, or other information.

Dynamic metadata is related to content currently being played on the broadcast and changes relatively frequently. The dynamic metadata may include a song name, artist name, album name, artist image (e.g., higher or lower resolutions), enhanced advertising (e.g., title, tag line, image, phone number, SMS number, URL search terms), program schedules (image, timeframe, title, artist name, DJ name, phone number, URL), service following data, or other information related to the audio content. When the radio receiver system is receiving an over-the-air radio broadcast signal from a particular radio station, the receiver system may receive static metadata and dynamic metadata wirelessly.

Hybrid radio systems can provide a user with an enhanced experience (e.g., an enhanced listening experience) regardless of the type of terrestrial broadcast signal that is received at the user's radio receiver system. For example, conventionally, a user receiving a conventional analog AM or FM radio broadcast signal is provided little, if any, metadata in addition to the received audio (e.g., a user's automotive receiver may display only a song title and artist name). By contrast, hybrid radio enhances the user's experience by providing a variety of different metadata in concert with the primary programming content. For example, users receiving radio broadcast signals at a receiver system may view images, videos, multimedia displays, text, etc., that is related to the programming content received in metadata via the over-the-air radio broadcast signals and wireless Internet.

The following description and the drawings sufficiently illustrate specific embodiments to enable those skilled in the art to understand the specific embodiment. Other embodiments may incorporate structural, logical, electrical, process, and other changes. Portions and features of various embodiments may be included in, or substituted for, those of other embodiments. Embodiments set forth in the claims encompass all available equivalents of those claims.

FIG. 1 is an illustration of portions of an example of a radio broadcast system 100 for providing metadata associated with over-the-air radio broadcast signals to one or more radio broadcast receivers. The system 100 includes a radio broadcast transmitter 105 that transmits an over-the-air radio broadcast to a radio broadcast receiver 110. The over-the-air radio broadcast is a one-way broadcast that can include an analog audio broadcast, a digital audio broadcast, and other text and numeric digital information. The system 100 also includes a service controller 115. The service controller 115 can be a server that can send formatted digital data suitable for transmission using the radio broadcast transmitter 105. The service controller 115 can also communicate data with the radio broadcast receiver 110 over an intermediate communication platform 120 such as, among other things, a telematics network, the Internet, or a cellular network. When the radio broadcast receiver 110 is tuned to a specific over-the-air radio broadcast, it is desired to send metadata to the receiver that is associated with the over-air radio broadcast and coordinate delivery of the metadata with the over-air-broadcast.

Figure 2:
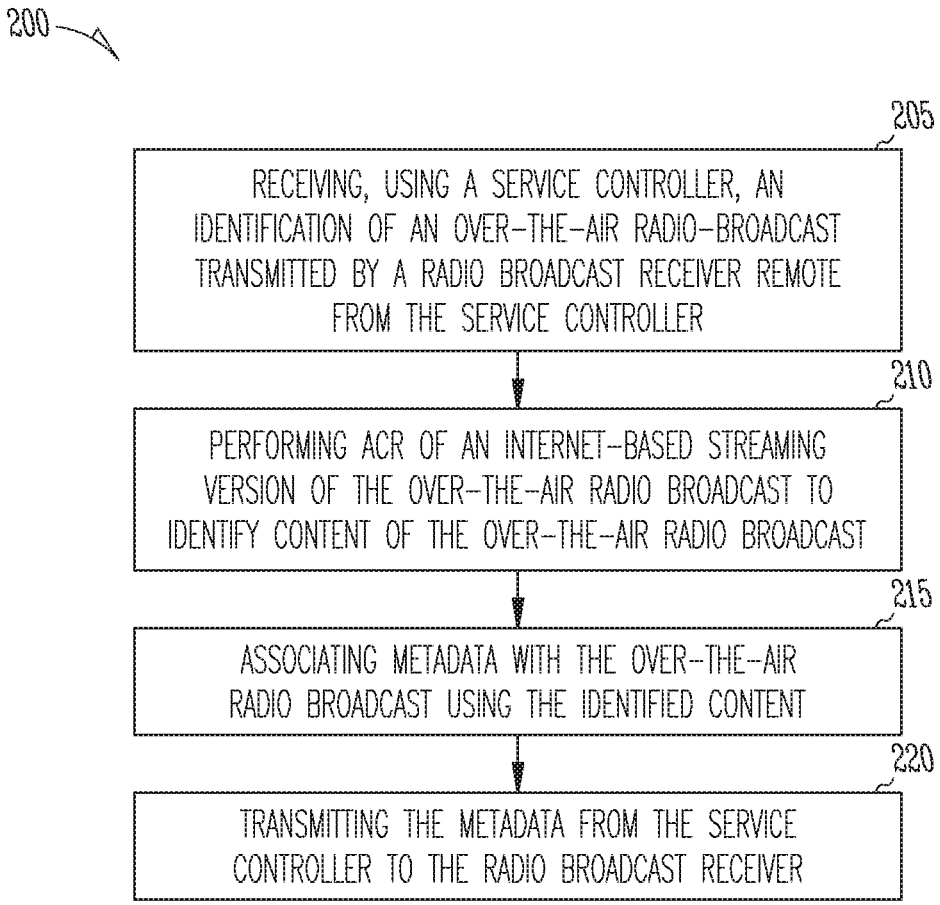
FIG. 2 is a flow diagram of an example of a method of providing supplemental data to a radio broadcast receiver.

FIG. 2 is a flow diagram of an example of a method 200 of providing the metadata to the radio broadcast receiver. At 205, an identification of an over-the-air radio broadcast is transmitted by the radio broadcast receiver to the service controller. The receiver is located remote from the service controller. For instance, the receiver may be mobile (e.g., the receiver may be an automotive receiver or included in a mobile phone). The identification can include data that indicates a frequency to which the receiver is tuned, or identifies a radio station to which the receiver is tuned. The identification information can be transmitted to the service controller using the intermediate communication platform 120.

At 210, automatic content recognition (ACR) of an internet-based streaming version of the over-the-air radio broadcast is performed to identify content of the over-the-air radio broadcast. ACR refers to the process where an entity (e.g., an application executing on a server) identifies content of the radio broadcast by sampling a portion of the audio and identifies contents of the sampled portion. ACR can include comparing the sampled portion to a signal fingerprint or signal watermark to identify the content. An over-the-air radio broadcast is often simultaneously provided as a streaming version broadcast over the Internet. The Internet-based version of the broadcast can be used for the ACR. The ACR may be performed by an ACR service provided by a third party. The third party ACR service may be a cloud-based ACR service.

FIG. 1 shows the service controller 115 requesting ACR service from cloud 125 and receiving information from the cloud 125 in response to the request. The term "cloud" is used herein to refer to a hardware abstraction. Instead of one dedicated server processing the ACR request and returning the ACR result, sending the ACR request to the cloud can include sending the ACR request to a data center or processing center, and the actual server used to process the ACR request is interchangeable at the data center or processing center. The service controller 115 may transmit a content recognition service request to the cloud-based ACR service. The request may be a message that includes the request and one or both of a radio station identifier or a URL that identifies the Internet-based streaming version of the over-the-air radio broadcast identified by the radio broadcast receiver. The ACR service is performed using the identified streaming version of the broadcast to identify content of the broadcast.

Returning to FIG. 2 at 215, metadata is associated with the radio broadcast content identified using the ACR. The service controller 115 may receive metadata associated with the broadcast from the cloud. In certain embodiments, the service controller 115 includes memory containing a database of metadata and the metadata is associated with the identified content using the service controller 115.

At 220, the metadata is transmitted from the service controller 115 to the radio broadcast receiver 110. The metadata can be transmitted from the service controller to the receiver using the intermediate communication platform 120 (e.g., via the Internet). In certain embodiments, the service controller 115 may initiate transmission of the metadata to the radio broadcast transmitter 105, and the radio broadcast transmitter 105 transmits the metadata to the receiver 110, such as by an IBOC transmission for example. The service controller 115 may initiate the transmission of metadata automatically or in response to a message from the receiver. The metadata associated with the over-the-air radio broadcast can include an image related to the over-the-air radio broadcast (e.g., an album image related to a song being played), purchase information related to the over-the-air radio broadcast, advertising information, a radio station logo, or an on-air personality image.

Figure 3:
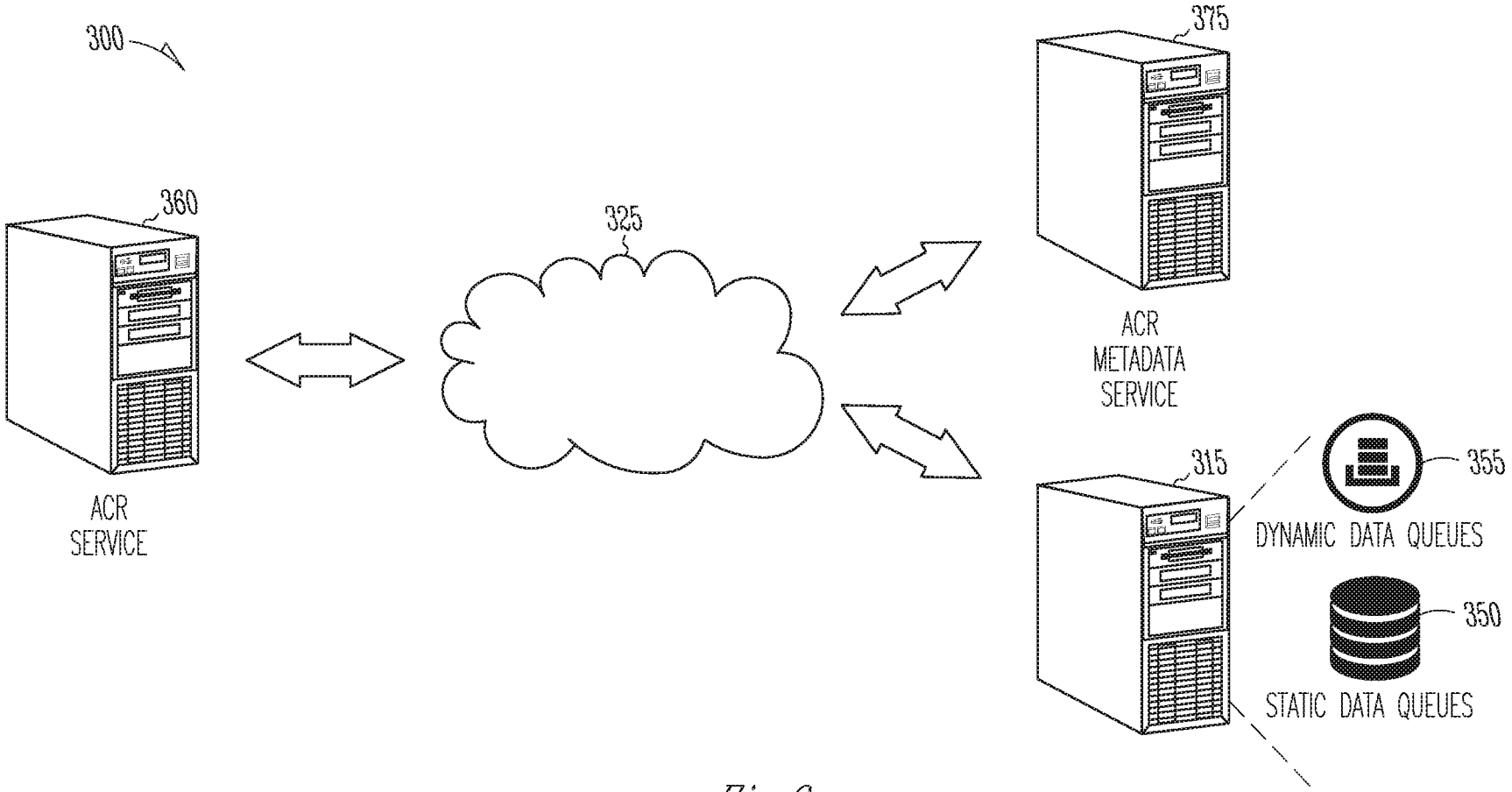
FIG. 3 is an illustration of portions of another example of a radio broadcast system for providing supplemental data to one or more radio broadcast receivers.

FIG. 3 is an illustration of portions of an example of a system 300 for providing metadata associated with over-the-air radio broadcasts to one or more radio broadcast receivers. The system includes a server 315 that communicates data with a radio broadcast receiver using an intermediate communication platform.

Figure 4:
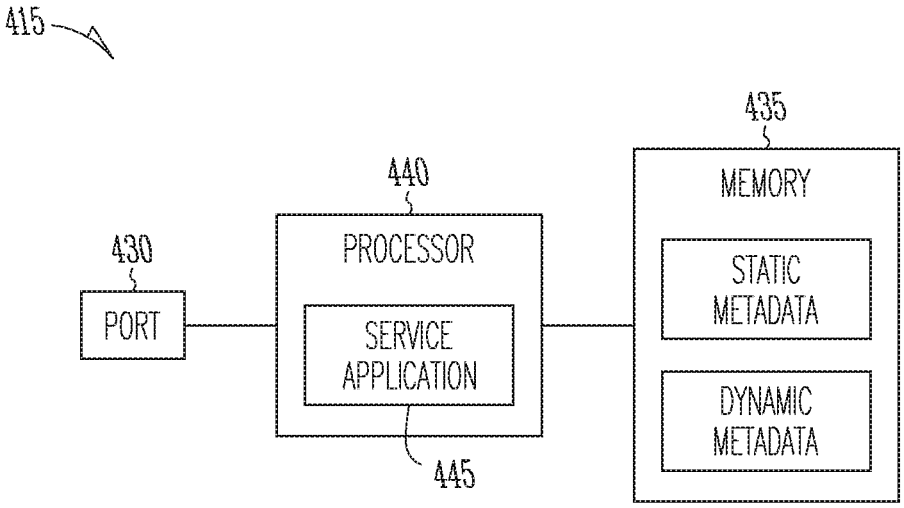
FIG. 4 is a block diagram of portions of an example of a server that provides supplemental data to a radio broadcast receiver.

FIG. 4 is a block diagram of portions of an example of the server 315 in FIG. 3. The server 415 in FIG. 4 includes a port 430, a memory 435, and a processor 440 operatively coupled to the port 430 and the memory 435. The server 415 also includes a service application 445 (e.g., a service application programming interface or service API) for execution by the processor 440. The service application 445 receives identification information related to an over-the-air radio broadcast. The identification information is transmitted to the server 415 using a radio broadcast receiver remote from the server 415, and the service application 445 receives the identification information via the port 430 (e.g., a communication port or COMM port). In response to receiving the identification information, the service application 445 communicates a request for ACR of an Internet-based streaming version of the over-the-air radio broadcast, and receives metadata associated with the over-the-air radio broadcast in response to the request. The service application 445 then initiates transmission of the metadata to the radio broadcast receiver.

Figure 5:
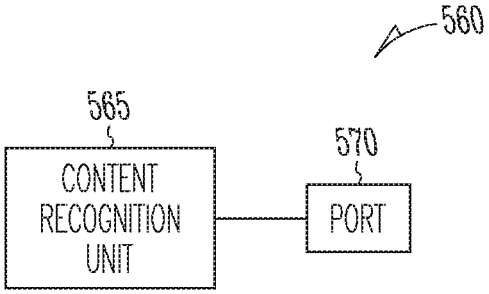
FIG. 5 is a block diagram of portions of an example of a server that provides an automatic content recognition service.

Returning to FIG. 3, the service application of server 315 may communicate the ACR request via cloud 325 to a cloud-based. ACR service. The metadata is received from a cloud-based metadata source in response to the request. In the example shown in FIG. 3, a second server 360 provides the ACR service. FIG. 5 is a block diagram of portions of an example of a server 560 that provides an ACR service. The server 560 includes a content recognition unit 565 and a port 570. An example of a content recognition unit 565 includes a processor executing an application that performs the ACR. The port 570 can be operatively coupled to an Internet access point to communicate information using the Internet.

The content recognition unit 565 receives a URL from a service application (e.g., via the cloud) that identifies the Internet-based streaming version of the over-the-air radio broadcast that was identified by the radio broadcast receiver. The content recognition unit 565 samples a portion of the Internet-based streaming version and identifies content of the Internet-based streaming version using a fingerprinting process or watermarking process. Metadata is associated with the over-the-air radio broadcast using the identified content. The metadata may be identified using the content recognition unit 565.

The metadata may be provided by the server 560 or a different server. In the example of FIG. 3, the system 300 includes a third party metadata service that provides metadata using a third server 375. The third party metadata service provides the metadata via the cloud 325 to the first server 315. The ACR service may communicate information to the metadata service that identifies the content of Internet-based streaming version of the over-the-air radio broadcast and the metadata service identifies the metadata associated with the over-the-air radio broadcast. In certain embodiments, the ACR service communicates information that identifies the metadata to be provided using the metadata service. In certain embodiments, the metadata is stored at the first server and a third party metadata service is not used.

As explained previously herein, metadata can be static or dynamic. Static metadata is mostly non-changing. For example, static metadata can be metadata associated with a radio station frequency or channel, such as a radio station logo or call letters. The static metadata stays the same even though the content of the radio broadcast changes, such as by broadcasting different songs. Dynamic metadata changes based on the content of the broadcast. For example, broadcast of a new song changes metadata that can include new image data for the new song such as image data of the artist or image data of the album corresponding to the song.

As shown in FIG. 3, the memory of the first server 315 can include a database 350 that stores static metadata. The memory also includes one or more queues 355 to hold dynamic metadata. The dynamic metadata includes the metadata associated with the over-the-air radio broadcast using the ACR. The service application of the server 315 initiates transmission of both static metadata and dynamic metadata associated with the over-the-air radio broadcast to the radio broadcast receiver.

The service application of server 315 may initiate transfer of other metadata to the radio broadcast receiver in addition to the dynamic metadata identified using ACR. For example, the service application may receive location information (e.g., latitude and longitude) sent by the radio broadcast receiver. The service application may initiate transmission of metadata associated with the location information to the radio broadcast receiver. The metadata may include advertising information based on the location of the receiver, or identification of radio stations available to the listener. In another example, the broadcaster of the over-the-air radio broadcast may provide metadata that is stored on the server 315 as either static or dynamic metadata. The service application initiates transmission of the metadata provided by the broadcaster to the radio broadcast receiver in response to the identification information received from the radio broadcast receiver.

As shown in the example of FIG. 1, there may be more than one path from the service application of the service controller 115 to the radio broadcast receiver 110. To send metadata to the receiver, the service application may initiate transmission of the metadata to the radio broadcast receiver via the intermediate communication platform 120 (e.g., via the Internet), The metadata (e.g., in the form of computer files, etc.) may be downloaded wirelessly from the service application of the service controller 115 to the radio broadcast receiver 110 using an Internet protocol, such as HyperText Transfer Protocol (HTTP). HyperText Transfer Protocol Secure (HTTPS), File Transfer Protocol (FTP) or File Transfer Protocol Secure (FTPS).

Another path to the receiver is the over-the-air broadcast via, the broadcast transmitter 105. The broadcast transmitter 105 may be a digital radio broadcast transmitter. The service controller 115 may include a port (e.g., a second COMM port in the example of FIG. 4) for operative coupling to the digital radio broadcast transmitter. The service application initiates transmission of the metadata to the digital radio broadcast transmitter via the second port, and the digital radio broadcast transmitter provides the metadata to the receiver 110, such as by an IBOC broadcast for example. The service application may use on or both of the transmission paths to send the metadata to the receiver.

The example in FIG. 1 shows the simplified case of one radio broadcast receiver 110. In an actual implementation, the service application transmits the metadata to multiple receivers that send the identification information related to the over-the-air radio broadcast. The service application may keep track of what is being played by multiple different radio stations by receiving identification of multiple radio broadcasts from radio receivers, and requesting cloud-based ACR of the Internet streaming version of the multiple broadcasts. The service application ends transmission of the metadata associated with the over-the-air radio broadcast when ceasing to receive the identification information.

Figure 6:
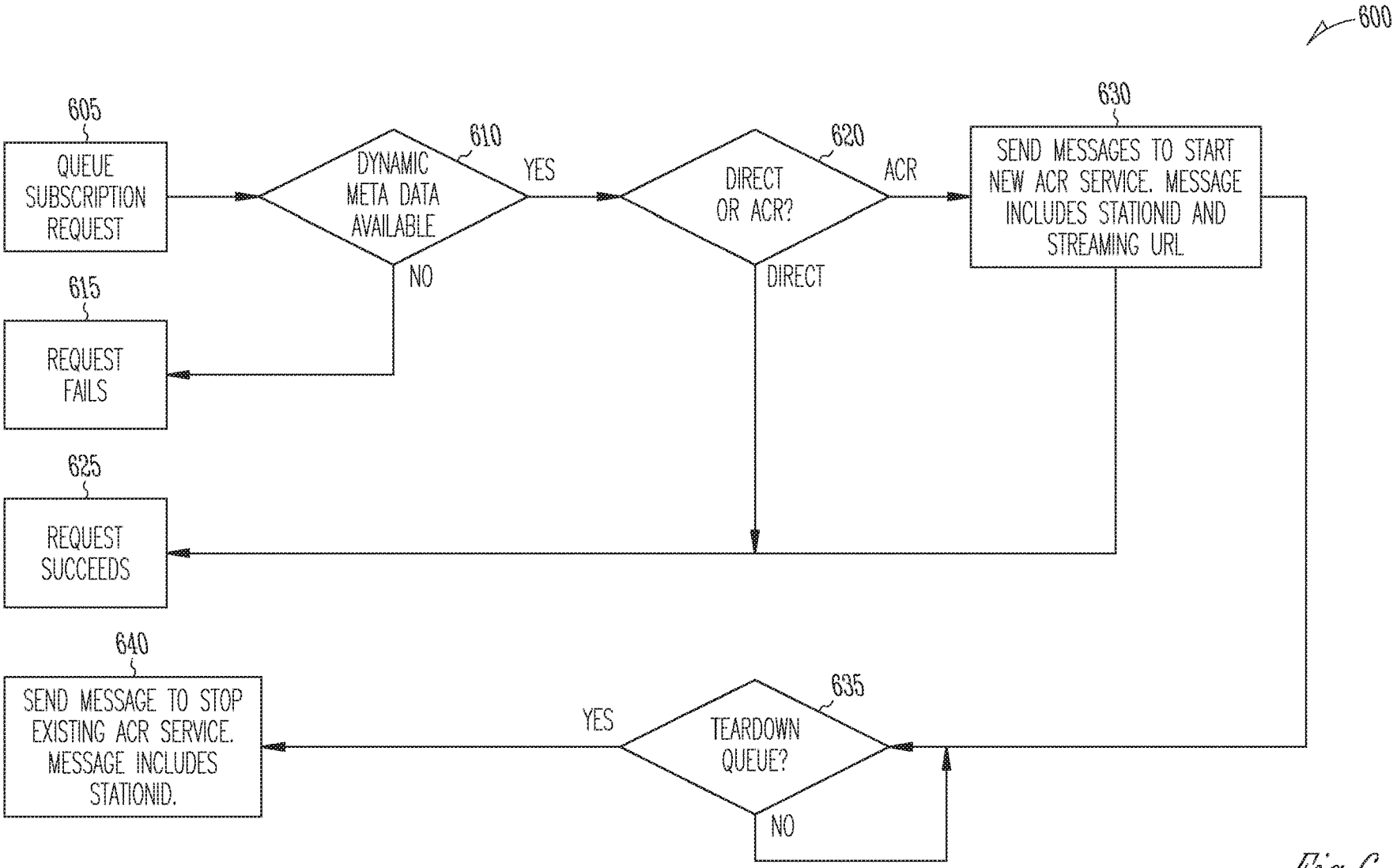
FIG. 6 is a flow diagram of an example of a method of controlling operation of a server to provide supplemental data to a radio broadcast receiver.

FIG. 6 is a flow diagram of an example of a method 600 of controlling operation of a server to provide metadata associated with over-the-air radio broadcasts to one or more radio broadcast receivers. At 605, a subscription request is received at the server (e.g., server 315 in FIG. 3). The subscription request may be transmitted from a radio tuner when a user tunes a radio broadcast receiver to a specific over-the-air radio broadcast.

At 610, when the request is processed, it is determined whether dynamic metadata is available that corresponds to the over-the-air radio broadcast. If dynamic metadata is not available, the subscription request fails at 615. If dynamic metadata is available, it is determined at 620 whether the availability of the metadata is direct and located at the server, or whether an ACR service is needed. If the dynamic metadata is directly available at the server, the metadata is sent to the receiver and the request is successful at 625.

If the dynamic metadata is not directly available and ACR service is needed, a message to start a new ACR service is sent as 630. The message may include a station identifier (StationID) and a URL identifying the internet-based broadcast corresponding to the over-the-air radio broadcast.

Figure 7:
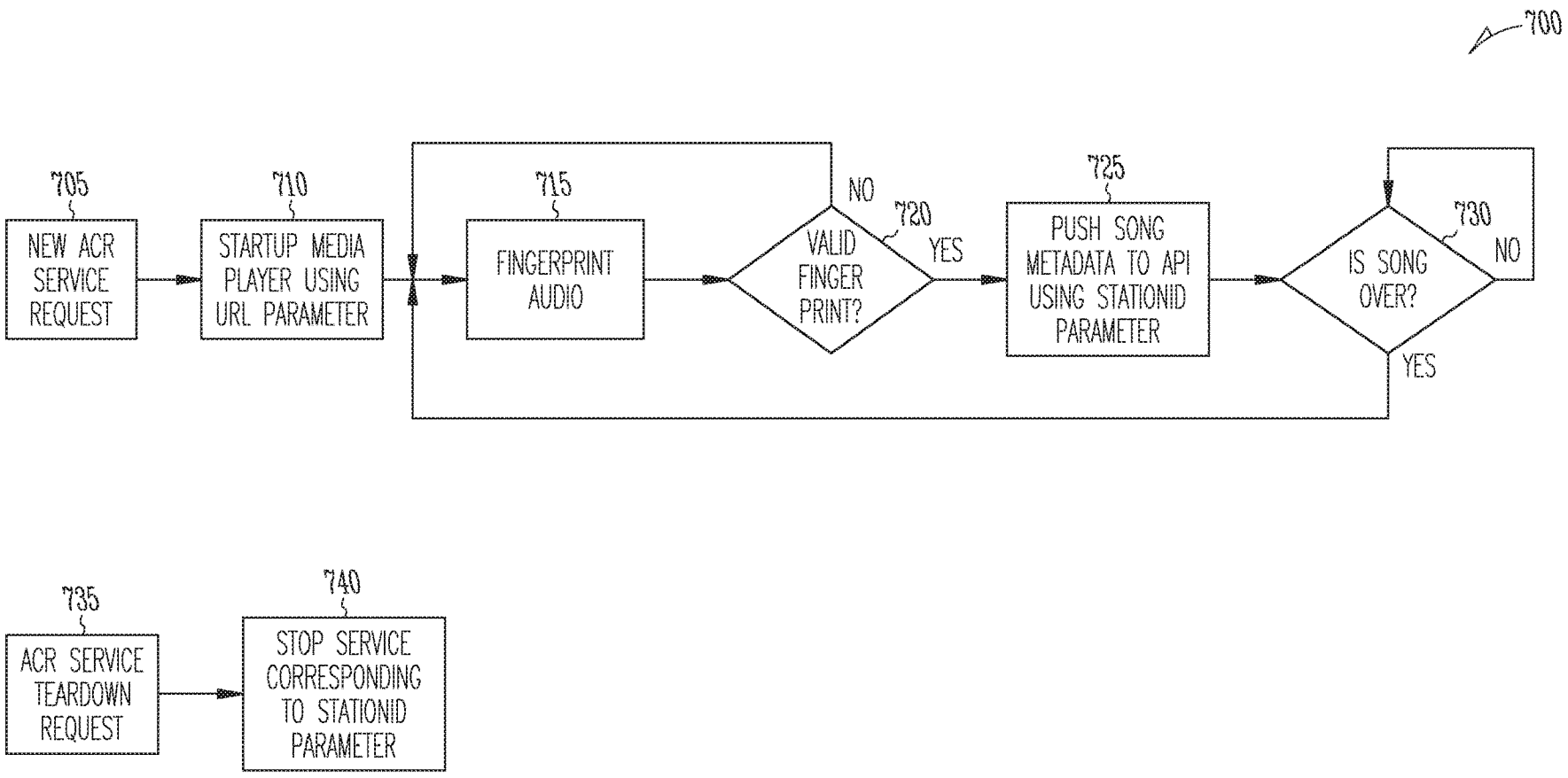
FIG. 7 is a flow diagram of an example of a method of controlling operation of a server to provide an automatic content recognition service.

FIG. 7 is a flow diagram of an example of a method 700 of controlling operation of a server to provide ACR services. At 705, the server (e.g., server 360 in FIG. 3) receives a new ACR service request message. The message can include a URL parameter to identify an internet broadcast and a StationID. At 710, the server starts a media player and the media is the streaming content identified using the URL parameter.

At 715, the audio portion of the media may fingerprinted to identify the content of the audio. If the fingerprint is a valid finger at 720, dynamic metadata associated with content (e.g., a song) identified by the fingerprinting is pushed to the requesting API using the StationID at 725. When the audio is completed (e.g., the song that is streamed is over) at 730, the next portion of the streaming audio may be fingerprinted at 715.

Returning to FIG. 6, the request is successful at 625 when the data is pushed to the requesting API. When the subscription requests ends (e.g., when the receiver is turned off by the user or when no requests corresponding to the Station ID are received), the server 315 of FIG. 3 may send an indication to stop sending metadata or to teardown the metadata queue at 635 in FIG. 6. At 640, the ACR service for that StationID is stopped. In FIG. 7, the ACR service teardown request is received by server 360 in FIG. 3 and the ACR service for the StationID is stopped at 740.

In addition or as an alternative to the cloud-based ACR service, ACR can be performed by one or more radio broadcast receivers receiving the over-air-radio broadcast and the identification of the broadcast content resulting from the ACR is transmitted to the service application by the one or more receivers. The receivers may perform ACR on a digital radio signal from a digital radio broadcast. Metadata can be associated with the broadcast content, and the service application initiates transmission of the metadata to all the receivers tuned to the over-the-air radio broadcast. This can be viewed as ACR by "crowd sourcing" where the identification of content of the radio broadcast is received by the service application from multiple sources.

In response to receiving the information identifying the content in the radio broadcast, the service application may communicate a request for the metadata to a cloud-based metadata source and receive the metadata from the cloud-based metadata source in response to the request. The service application may also receive information related to location of the receivers. The service application may also request cloud-based ACR from cloud-based ACR service in addition to the ACR information provided by the one or more receivers. The service application initiates transmission of one or more of: metadata associated with the content of the broadcast, metadata associated with location of the receivers, and metadata provided by the broadcaster to the receivers tuned to the broadcast. The service application ends transmission of the metadata to the receivers when the service application no longer receives identification of content of the radio broadcast and the information identifying the over-air-broadcast.

The systems, devices, and methods described provide for coordination of metadata with an over-the-air radio broadcast. The metadata can be displayed using the radio broadcast receiver. This provides an enriched experience of the radio broadcast for the user.

Additional Examples and Disclosure

Example 1 includes subject matter (such as a system for providing metadata associated with over-the-air radio broadcasts to one or more radio receivers) comprising a first server. The first server can include a port, a memory, a processor operatively coupled to the port and memory, and a service application for execution by the processor. The service application can optionally be configured to: receive identification information related to an over-the-air radio broadcast via the port of the first server, wherein the identification information is transmitted to the first server using a radio broadcast receiver remote from the first server; communicate a request for automatic content recognition (ACR) of an Internet-based streaming version of the over-the-air radio broadcast; and receive metadata associated with the over-the-air radio broadcast in response to the request and initiate transmission of the metadata to the radio broadcast receiver.

In Example 2, the subject matter of Example 1 optionally includes the first server optionally configured to communicate the request for ACR to a cloud-based ACR service and receive the metadata from a cloud-based metadata source in response to the request.

In Example 3, the subject matter of one or both of Examples 1 and 2 optionally includes a second server including a content recognition unit and a port for operative coupling to an Internet access point. The content recognition unit is optionally configured to: receive a uniform resource locator (URL) from the service application identifying the Internet-based streaming version of the over-the-air radio broadcast; perform ACR using the Internet-based streaming version; and associate the metadata with the over-the-air radio broadcast using identified content of the Internet-based streaming version.

In Example 4, the subject matter of one or any combination of Examples 1-3 optionally includes a memory including a database configured to store static metadata, and one or more queues configured to store dynamic metadata. The dynamic metadata optionally includes the metadata associated with the over-the-air radio broadcast using the ACR, and the service application is optionally configured to initiate transmission of both static metadata and dynamic metadata associated with the over-the-air radio broadcast to the radio broadcast receiver.

In Example 5, the subject matter of one or any combination of Examples 1-4 optionally includes the first server configured to receive location information sent by the radio broadcast receiver; and the service application is optionally configured to initiate transmission of metadata associated with the location information to the radio broadcast receiver.

In Example 6, the subject matter of one or any combination of Examples 1-5 optionally includes a service application configured to initiate transmission of metadata provided by a broadcaster associated with the over-the-air radio broadcast to the radio broadcast receiver.

In Example 7, the subject matter of one or any combination of Examples 1-6 optionally includes the first server configured to receive the identification information from a plurality of the broadcast radio receivers and to transmit the metadata to the plurality of radio broadcast receivers. The service application is optionally configured to end transmission of the metadata associated with the over-the-air radio broadcast when ceasing to receive the identification information.

In Example 8, the subject matter of Example 7 optionally includes a service application configured to receive identification of content of the over-the-air radio broadcast from one or more radio broadcast receivers of the plurality of radio broadcast receivers; and initiate transmission of metadata associated with identified content of the over-the-air radio broadcast received from the one or more radio broadcast receivers to the plurality of radio broadcast receivers.

In Example 9, the subject matter of one or any combination of Examples 1-8 optionally includes a service application configured to initiate transmission of the metadata to the radio broadcast receiver via the Internet.

In Example 10, the subject matter of one or any combination of Examples 1-9 optionally includes the first server including a second port for operative coupling to a digital radio broadcast transmitter. The service application is optionally configured to initiate transmission of the metadata to the digital radio broadcast transmitter via the second port.

In Example 11, the subject matter of one any combination of Examples 1-10 optionally includes the metadata that is associated with the over-the-air radio broadcast including at least one of an image related to the over-the-air radio broadcast, purchase information related to the over-the-air radio broadcast, advertising information, a radio station logo, and an on-air personality image.

Example 12 includes subject matter (such as method for providing metadata associated with over-the-air radio broadcast signals, a means for performing acts, or a machine-readable medium including instructions that, when performed by the machine, cause the machine to perform acts), or can optionally be combined with the subject matter of one or any combination of Examples 1-11 to include such subject matter, comprising: receiving, using a service controller, an identification of an over-the-air radio-broadcast transmitted by a radio broadcast receiver remote from the service controller; performing automatic content recognition (ACR) of an internet-based streaming version of the over-the-air radio broadcast to identify content of the over-the-air radio broadcast; associating metadata with the over-the-air radio broadcast using the identified content; and transmitting the metadata from the service controller to the radio broadcast receiver.

In Example 13, the subject matter of Example 12 optionally includes transmitting a content recognition service request from the service controller to a cloud-based ACR service, and receiving, by the service controller, dynamic metadata from a cloud-based metadata service provider in response to the content recognition service request.

In Example 14, the subject matter of Example 13 optionally includes transmitting a message that includes the request, and one or both of a radio station identifier and a uniform resource locator (URL) identifying the internet-based streaming version of the over-the-air radio broadcast.

In Example 15, the subject matter of one or any combination of Examples 12-14 optionally includes receiving, by the service controller, location information from the radio receiver; and transmitting metadata associated with both the over-the-air radio broadcast and the location information to the radio broadcast receiver.

In Example 16, the subject matter of one or any combination of Examples 12-15 optionally includes transmitting, by the service controller, metadata provided to the service controller by a broadcaster of the over-the-air radio broadcast.

In Example 17, the subject matter of one or any combination of Examples 12-16 optionally includes receiving the identification from a plurality of radio broadcast receivers, transmitting the metadata from the service controller to the plurality of radio broadcast receivers, and ceasing the transmitting of the metadata when the service controller ceases to receive the identification of the over-the-air radio broadcast.

In Example 18, the subject matter of Example 17 optionally includes receiving, by the service controller, identification of content of the over-the-air radio broadcast from one or more radio broadcast receivers of the plurality of radio broadcast receivers; and transmitting metadata associated with identified content of the over-the-air radio broadcast to the plurality of radio broadcast receivers.

In Example 19, the subject matter of Example 18 optionally includes obtaining identification information of the content of the over-the-air radio broadcast by one of: performing ACR using the one or more radio broadcast receivers, or extracting the identification information from digital information included in the over-the-air broadcast using the one or more radio broadcast receivers. The method further includes transmitting the identification information to the service controller.

In Example 20, the subject matter of one or any combination of Examples 12-19 optionally includes associating dynamic metadata with the over-the-air radio broadcast, and transmitting both static metadata and dynamic metadata from the service controller to the radio receiver according to the identification of the over-the-air radio broadcast.

In Example 21, the subject matter of one or any combination of Examples 12-20 optionally includes the service controller transmitting the metadata to the radio broadcast receiver using the internet.

In Example 22, the subject matter of one or any combination of Examples 12-21 optionally includes the service controller initiating transmission of the metadata to the radio broadcast receiver using the over-the-air radio broadcast.

Example 23 includes subject matter (such as a system for providing metadata associated with over-the-air radio broadcast signals to one or more radio receivers), or can optionally be combined with the subject matter of one or any combination of Examples to include such subject matter, comprising: a first server including: a port, a memory, a processor operatively coupled to the port and memory, and a service application for execution by the processor. The service application is configured to receive identification information of an over-the-air radio broadcast from a plurality of radio broadcast receivers remote from the first server; receive identification information of content broadcast in the over-the-air radio broadcast from a radio broadcast receiver of the plurality of radio broadcast receivers; and initiate transmission of metadata associated with the content broadcast in the over-the-air radio broadcast to the plurality of radio broadcast receivers.

In Example 24, the subject matter of Example 23 optionally includes a service application configured to communicate a request for the metadata to a cloud-based metadata source and receive the metadata from the cloud-based metadata source in response to the request.

In Example 25, the subject matter of one or both of Examples 23 and 24 optionally includes a service application configured to communicate a request for ACR service to a cloud-based ACR service; receive further identification information of content broadcast in the over-the-air radio broadcast from the cloud-based ACR service; communicate a request for the metadata to a cloud-based metadata source; and receive the metadata from the cloud-based metadata source in response to the request.

In Example 26, the subject matter of one or any combination of Examples 23-25 optionally includes a content recognition unit and a port for operative coupling to an Internet access point. The service application of the first server is configured to communicate a request for automatic content recognition (ACR) of an Internet-based streaming version of the over-the-air radio broadcast to the content recognition unit, and the request includes a uniform resource locator (URL) from the service application identifying the Internet-based streaming version of the over-the-air radio broadcast. The content recognition unit is configured to: perform ACR using the Internet-based streaming version in response to the request; and associate metadata with the over-the-air radio broadcast using identified content.

In Example 27, the subject matter of one or any combination of Examples 23-26 optionally includes the service application of the first server configured to initiate transmission of the metadata to the plurality of radio broadcast receivers via the Internet.

In Example 28, the subject matter of one or any combination of Examples 23-27 optionally includes the first server including a second port for operative coupling to a digital radio broadcast transmitter. The service application is optionally configured to initiate transmission of the metadata to the digital radio broadcast transmitter via the second port.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. In the above Detailed Description, various features may be grouped together to streamline the disclosure. This should not be interpreted as intending that an unclaimed disclosed feature is essential to any claim. Rather, the subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope should be determined with reference to the appended claims, along with the full scope of equivalents to which such claims are entitled.

What is claimed is:

1. A system for providing metadata associated with over-the-air radio broadcasts to one or more radio broadcast receivers, the system comprising:

a first server including a port, a memory, a processor operatively coupled to the port and memory, and a service application for execution by the processor, wherein the service application is configured to:

receive identification information related to an over-the-air radio broadcast via the port of the first server, wherein the identification information is transmitted to the first server using a radio broadcast receiver remote from the first server;

communicate a request for automatic content recognition (ACR) of an Internet-based streaming version of the over-the-air radio broadcast, the request including a uniform resource locator (URL) identifying the Internet-based streaming version of the over-the-air radio broadcast; and receive metadata associated with the over-the-air radio broadcast in response to the request and initiate transmission of the metadata to the radio broadcast receiver; and a second server including a content recognition unit and a port for operative coupling to an Internet access point, wherein the content recognition unit is configured to:

receive the request including the URL identifying the Internet-based streaming version of the over-the-air radio broadcast from the service application;

perform ACR using the Internet-based streaming version of the over-the-air radio broadcast to identify content of the over-the-air broadcast; and associate the metadata with the over-the-air radio broadcast using the content identified by the ACR using the Internet-based streaming version of the over-the-air radio broadcast.

2. The system of claim 1, wherein the second server is part of a cloud-based ACR service.

3. The system of claim 1, wherein the memory includes a database configured to store static metadata, and one or more queues configured to store dynamic metadata; wherein the dynamic metadata includes the metadata associated with the over-the-air radio broadcast using the ACR; and wherein the service application is configured to initiate transmission of both static metadata and dynamic metadata associated with the over-the-air radio broadcast to the radio broadcast receiver.

4. The system of claim 1, wherein the first server is configured to receive location information sent by the radio broadcast receiver; and wherein the service application is configured to initiate transmission of metadata associated with the location information to the radio broadcast receiver.

5. The system of claim 1, wherein the service application is configured to initiate transmission of metadata provided by a broadcaster associated with the over-the-air radio broadcast to the radio broadcast receiver.

6. The system of claim 1, wherein the first server is configured to receive the identification information from a plurality of the radio broadcast receivers and transmit the metadata to the plurality of radio broadcast receivers, and wherein the service application is configured to end transmission of the metadata associated with the over-the-air radio broadcast when ceasing to receive the identification information.

7. The system of claim 6, wherein the service application is configured to receive identification of content of the over-the-air radio broadcast from one or more radio broadcast receivers of the plurality of radio broadcast receivers; and initiate transmission of metadata associated with identified content of the over-the-air radio broadcast received from the one or more radio broadcast receivers to the plurality of radio broadcast receivers.

8. The system of claim 1, wherein the service application is configured to initiate transmission of the metadata to the radio broadcast receiver via the Internet.

9. The system of claim 1, wherein the first server includes a second port for operative coupling to a digital radio broadcast transmitter, and wherein the service application is configured to initiate transmission of the metadata to the digital radio broadcast transmitter via the second port.

10. The system of claim 1, wherein the metadata associated with the over-the-air radio broadcast includes at least one of an image related to the over-the-air radio broadcast, purchase information related to the over-the-air radio broadcast, advertising information, a radio station logo, and an on-air personality image.

11. A method for providing metadata associated with over-the-air radio broadcast signals, the method comprising:

receiving, using a service controller, an identification of an over-the-air radio broadcast transmitted by a radio broadcast receiver remote from the service controller;

communicating, using the service controller, a request for automatic content recognition (ACR) of an Internet-based streaming version of the over-the-air radio broadcast, the request including a uniform resource locator (URL) identifying the Internet-based streaming version of the over-the-air radio broadcast; and receiving, using the service controller, metadata associated with the over-the-air radio broadcast in response to the request and transmitting the metadata from the service controller to the radio broadcast receiver;

wherein ACR is performed using the Internet-based streaming version of the over-the-air radio broadcast to identify content of the over-the-air broadcast in response to the request for ACR; and wherein metadata is associated with the over-the-air radio broadcast using the content identified by the ACR using the Internet-based streaming version of the over-the-air radio broadcast.

12. The method of claim 11, wherein the request for ACR is communicated from the service controller to a cloud-based ACR service, and wherein the metadata associated with the over-the-air radio broadcast includes dynamic metadata received from a cloud-based metadata service provider in response to the request for ACR.

13. The method of claim 11, including: receiving, by the service controller, location information from the radio broadcast receiver; and transmitting metadata associated with both the over-the-air radio broadcast and the location information to the radio broadcast receiver.

14. The method of claim 11, including transmitting, by the service controller, metadata provided to the service controller by a broadcaster of the over-the-air radio broadcast.

15. The method of claim 11, wherein the receiving the identification of an over-the-air radio broadcast includes receiving the identification from a plurality of radio broadcast receivers, wherein transmitting the metadata includes transmitting the metadata from the service controller to the plurality of radio broadcast receivers, and wherein the method further includes ceasing the transmitting of the metadata when the service controller ceases to receive the identification of the over-the-air radio broadcast.

16. The method of claim 15, including: receiving, by the service controller, identification of content of the over-the-air radio broadcast from one or more radio broadcast receivers of the plurality of radio broadcast receivers; and wherein transmitting the metadata includes transmitting metadata associated with identified content of the over-the-air radio broadcast to the plurality of radio broadcast receivers.

17. The method of claim 16, including: obtaining identification information of the content of the over-the-air radio broadcast by one of: performing ACR using the one or more radio broadcast receivers, or extracting the identification information from digital information included in the over-the-air radio broadcast using the one or more radio broadcast receivers; and transmitting the identification information to the service controller.

18. The method of claim 11, wherein the metadata associated with the over-the-air radio broadcast includes dynamic metadata, and wherein transmitting the metadata comprises transmitting both static metadata and the dynamic metadata from the service controller to the radio broadcast receiver.

19. The method of claim 11, wherein transmitting the metadata includes the service controller transmitting the metadata to the radio broadcast receiver using the Internet.

20. The method of claim 11, wherein transmitting the metadata includes the service controller initiating transmission of the metadata to the radio broadcast receiver using the over-the-air radio broadcast.

* * * * *